US005896755A

United States Patent [19]

Wong et al.

[11] Patent Number: 5,896,755

[45] Date of Patent: Apr. 27, 1999

[54] CRYOGENIC RECTIFICATION SYSTEM WITH MODULAR COLD BOXES

[75] Inventors: Kenneth Kai Wong, Amherst; Dante Patrick Bonaquist, Grand Island; John Frederic Billingham, Getzville; Michael Douglas Monteith, Kenmore; Neil Mark Prosser, Lockport, all of N.Y.

[73] Assignee: Praxair Technology, Inc., Danbury, Conn.

[21] Appl. No.: 09/113,174

[22] Filed: Jul. 10, 1998

[51] Int. Cl.[6] ..... F25J 3/00; F25J 5/00

[52] U.S. Cl. ..... 62/643; 62/911

[58] Field of Search ..... 62/643, 617, 902, 62/911, 298

[56] References Cited

U.S. PATENT DOCUMENTS

| | | | |
|---|---|---|---|
| 33,878 | 4/1861 | Bartlett et al. | 62/47.1 |
| 3,750,413 | 8/1973 | Milligan et al. | 29/423 |
| 4,957,523 | 9/1990 | Zarate et al. | 62/646 |
| 5,233,838 | 8/1993 | Howard | 62/25 |
| 5,245,832 | 9/1993 | Roberts | 62/24 |
| 5,339,648 | 8/1994 | Lockett et al. | 62/24 |
| 5,349,827 | 9/1994 | Bracque et al. | 62/298 |
| 5,546,767 | 8/1996 | Dray et al. | 62/646 |
| 5,611,219 | 3/1997 | Bonaquist | 62/646 |

*Primary Examiner*—William Doerrler
*Attorney, Agent, or Firm*—Stanley Ktorides

[57] ABSTRACT

A cryogenic rectification system for producing oxygen having a feed air preparation system and a plurality of same size cold box modules operating in parallel and in conjunction with the feed air preparation system.

6 Claims, 1 Drawing Sheet

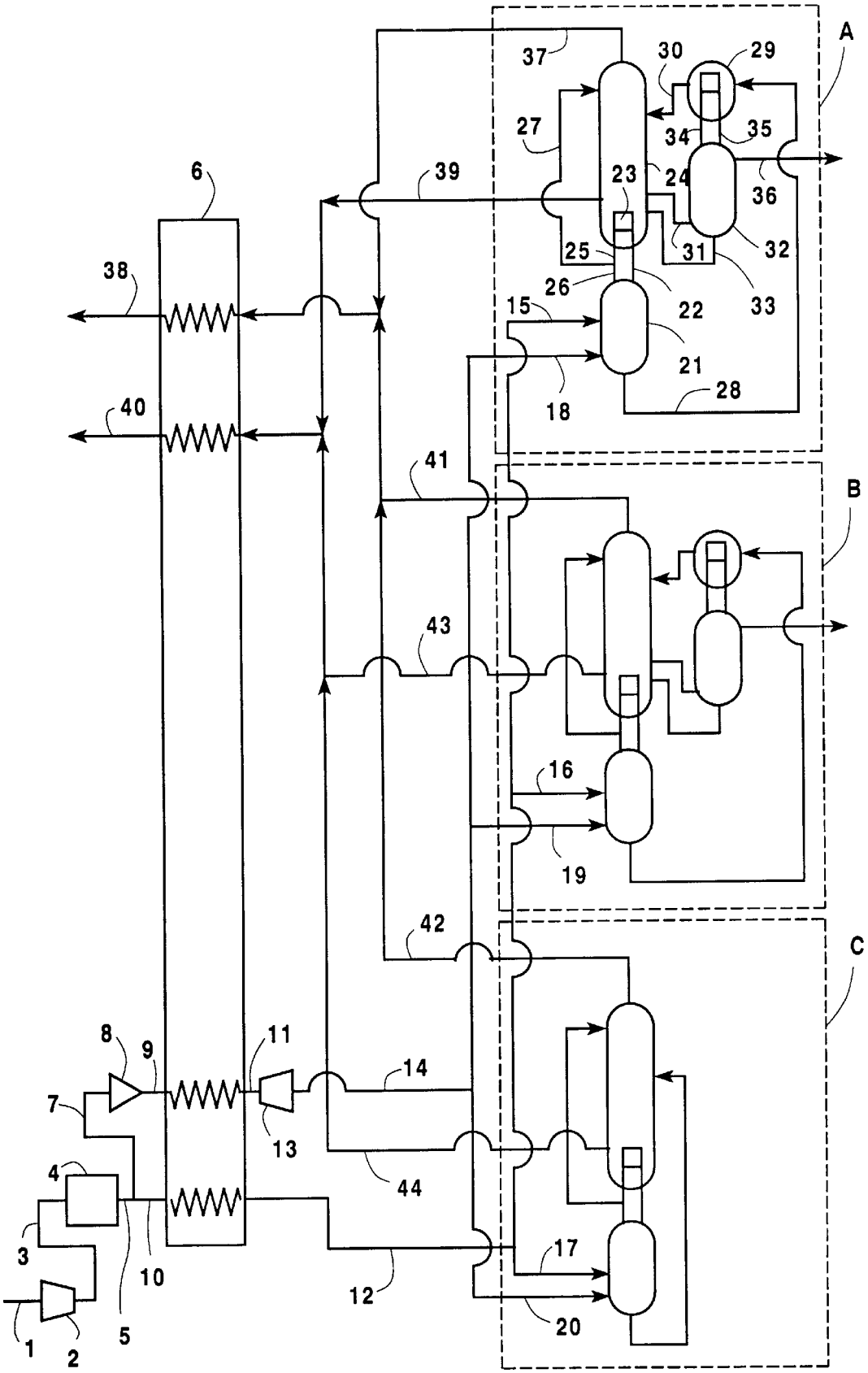
A
B
C
1
2
3
4
5
6
7
8
9
10
11
12
13
14
15
16
17
18
19
20
21
22
23
24
25
26
27
28
29
30
31
32
33
34
35
36
37
38
39
40
41
42
43
44

CRYOGENIC RECTIFICATION SYSTEM WITH MODULAR COLD BOXES

TECHNICAL FIELD

This invention relates generally to the cryogenic rectification of feed air and, more particularly, to the cryogenic rectification of feed air to produce oxygen.

BACKGROUND ART

Oxygen is produced in large quantities by the cryogenic rectification of feed air in a cold box comprising one or more columns. Prior to entering the cold box the feed air is initially processed in a feed air preparation system wherein the feed air is compressed, cooled and cleaned of high boiling impurities, such as water vapor, carbon dioxide and/or hydrocarbons, which would otherwise solidify at the low temperatures of the cryogenic rectification. Typically the feed air preparation system utilizes relatively standard equipment. However, the cold box, and in particular the column or columns of the cold box, must be designed specifically of each individual cryogenic rectification plant depending upon the desired production of product oxygen by that plant. This individual design of each individual cold box is costly and time consuming.

Accordingly it is an object of this invention to provide a cryogenic rectification system which enables one to have cryogenic rectification plants of different capacities without need for a different cold box design for each such cryogenic rectification plant.

SUMMARY OF THE INVENTION

The above and other objects, which will become apparent to those skilled in the art upon a reading of this disclosure, are attained by the present invention, one aspect of which is:

A method for carrying out cryogenic rectification of feed air to produce oxygen comprising:

(A) processing feed air in a feed air preparation system to produce prepared feed air;

(B) passing the prepared feed air in a plurality of inputs into a plurality of cold boxes, each of said inputs having the same flowrate and passed into a single cold box;

(C) producing oxygen by cryogenic rectification in each of the cold boxes, and (D) passing oxygen from each of the cold boxes to the feed air preparation system and recovering product oxygen from the feed air preparation system.

Another aspect of the invention is:

Apparatus for carrying out cryogenic rectification of feed air to produce oxygen comprising:

(A) a feed air preparation system and means for passing feed air into the feed air preparation system;

(B) a plurality of cold boxes, each cold box having the same capacity, and means for passing feed air from the feed air preparation system into each of the cold boxes;

(C) means for passing oxygen from each of the cold boxes to the feed air preparation system; and (D) means for recovering product oxygen from the feed air preparation system.

As used herein the term "product oxygen" means a fluid having an oxygen concentration greater than 80 mole percent, preferably greater than 95 mole percent.

As used herein the term "product nitrogen" means a fluid having a nitrogen concentration greater than 95 mole percent, preferably greater than 99 mole percent.

As used herein the term "product argon" means a fluid having an argon concentration greater than 80 mole percent, preferably greater than 95 mole percent.

As used herein the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements which may be structured packing and/or random packing elements. For a further discussion of distillation columns see the Chemical Engineers' Handbook fifth edition, edited by R. J. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or a differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein the term "indirect heat exchange" means the bringing of two fluids into heat exchange relation without any physical contact or intermixing of the fluids with each other.

As used herein the term "feed air" means a mixture comprising primarily oxygen, nitrogen and argon such as ambient air.

As used herein the term "prepared feed air" means feed air which is at greater than ambient pressure, cooler than ambient temperature, and relatively free of high boiling impurities which would otherwise cause solidification problems during cryogenic rectification.

As used herein the terms "turboexpansion" and "turboexpander" mean respectively method and apparatus for the flow of high pressure gas through a turbine to reduce the pressure and the temperature of the gas, thereby generating refrigeration.

As used herein the term "cold box" means a facility for cryogenic rectification of feed air, comprising one or more columns and the piping, valving and heat exchange equipment attendant thereto.

As used herein the term "same flowrate" means within plus or minus five percent.

As used herein the term "same capacity" means within plus or minus five percent of product oxygen capacity.

As used herein the term "argon column" means a column which receives a feed comprising argon and produces by cryogenic rectification a product having an argon concentration which exceeds that of the feed.

BRIEF DESCRIPTION OF THE DRAWING

The sole FIGURE is a simplified schematic representation of one preferred embodiment of the invention.

DETAILED DESCRIPTION

In the practice of this invention more than one cold box is used in conjunction with a single feed air preparation system. Moreover, each of the cold boxes has the same capacity. The oxygen produced by each of the cold boxes aggregates to the desired product oxygen production rate for the facility. Product nitrogen and/or product argon may also be produced by one or more of the cold boxes.

The invention will be described in detail with reference to the Drawing. Referring now to the Figure, feed air 1 is compressed in compressor 2 to a pressure generally within the range of from 50 to 250 pounds per square inch absolute (psia). Pressurized feed air 3 is cleaned of high boiling impurities such as water vapor, carbon dioxide and hydrocarbons by passage through purifier 4 which is typically a temperature or a pressure swing adsorption purifier. Cleaned, compressed feed air 5 is then cooled by indirect heat exchange with return streams in primary heat exchanger 6. In the embodiment of the invention illustrated in the Figure a portion 7 of feed air 5 is further compressed by passage through booster compressor 8, and further compressed feed air 9 and remaining compressed feed air 10 are cooled by passage through primary heat exchanger 6 to produce compressed, cleaned and cooled feed air, i.e. prepared feed air, in streams 11 and 12 respectively. As can be seen, the feed air preparation system of the embodiment illustrated in the Figure comprises compressor 2, purifier 4 and heat exchanger 6. In the embodiment illustrated in the Figure feed air 11 is turboexpanded to form stream 14 by passage through turboexpander 13 to generate refrigeration for the subsequent cryogenic rectification.

The embodiment of the invention illustrated in the Figure employs three cold boxes designated A, B and C. Each of the cold boxes has the same capacity, e.g. 250 tons per day of product oxygen. Each of the cold boxes employs a double column system wherein product nitrogen may also be produced. Two of the cold boxes, i.e. cold box A and cold box B, also employ an argon sidearm column wherein product argon is produced. Each of the cold boxes receives a feed air input, in one or more streams, which is at the same total input flowrate as the input received by each of the other cold boxes. The operation of the cold boxes will be described in greater detail with reference to cold box A, with the understanding that the operation of the other cold boxes is similar to that of cold box A.

Referring back now to the Figure, feed air 12 is divided into three streams 15, 16 and 17 and feed air 14 is divided into three streams 18, 19 and 20. Streams 15 and 18 form the input into cold box A, streams 16 and 19 form the input into cold box B and streams 17 and 20 form the input into cold box C. The inputs into cold boxes A, B and C each have the same flowrate, e. g. 1.2 million cfh. In the embodiment of the invention illustrated in the Figure, the entire input is shown as introduced into the higher pressure column of each cold box. Those skilled in the art will recognize that some of the input to each cold box could be introduced into the lower pressure column.

Prepared feed air input in streams 15 and 18 is passed into higher pressure column 21 which is operating at a pressure generally within the range of from 50 to 250 psia. Within higher pressure column 21 the feed air is separated by cryogenic rectification into nitrogen-enriched vapor and oxygen-enriched liquid. Nitrogen-enriched vapor is passed in stream 22 into main condenser 23 wherein it is condensed by indirect heat exchange with lower pressure column 24 bottom liquid to form nitrogen-enriched liquid 25. A portion 26 of nitrogen-enriched liquid 25 is returned to higher pressure column 21 as reflux, and another portion 27 of nitrogen-enriched liquid 25 is passed into lower pressure column 24 as reflux. Oxygen-enriched liquid is passed from the lower portion of higher pressure column 21 in stream 28 into argon column top condenser 29 wherein it is at least partially vaporized by indirect heat exchange with argon-richer vapor, and the resulting oxygen-enriched fluid is passed as illustrated by stream 30 from top condenser 29 into lower pressure column 24.

A stream 31 comprising oxygen and argon is passed from lower pressure column 24 into argon column 32 wherein it is separated by cryogenic rectification into argon-richer vapor and oxygen-richer liquid. The oxygen-richer liquid is returned to lower pressure column 24 in stream 33. The argon-richer vapor is passed in stream 34 into top condenser 29 wherein it condenses by indirect heat exchange with the vaporizing oxygen-enriched liquid as was previously described. Resulting argon-richer liquid is returned in stream 35 to argon-column 32 as reflux. Argon-richer fluid, as vapor and/or liquid is recovered from the upper portion of argon column 32 as product argon in stream 36.

Lower pressure column 24 is operating at a pressure less than that of higher pressure column 21 and generally within the range of from 16 to 80 psia. Within lower pressure column 24 the various feeds into the column are separated by cryogenic rectification into nitrogen-rich fluid and oxygen-rich fluid. Nitrogen-rich fluid is withdrawn from the upper portion of lower pressure column 24 as vapor stream 37, warmed by passage through primary heat exchanger 6 and recovered as product nitrogen 38. Oxygen-rich fluid is withdrawn from the lower portion of lower pressure column 24 as vapor and/or liquid. If withdrawn as a liquid, the oxygen-rich liquid may be pumped to a higher pressure and vaporized either in a separate product boiler or in primary heat exchanger 6 prior to recovery as high pressure product oxygen. In the embodiment illustrated in the Figure oxygen-rich fluid is withdrawn from lower pressure column 24 as vapor stream 39, warmed by passage through primary heat exchanger 6 and recovered a product oxygen 40.

The operations of cold boxes B and C are similar to that of cold box A except that cold box C does not employ an argon column and therefore the oxygen-enriched liquid is passed directly from the higher pressure column into the lower pressure column. The operations of cold boxes B and C will therefore not be described in detail. Each of cold boxes B and C produce nitrogen in addition to oxygen. In the embodiment illustrated in the Figure, nitrogen-rich vapor from each of cold boxes B and C is passed in streams 41 and 42 respectively into stream 37, and passed as one stream through primary heat exchanger 6 prior to recovery as product nitrogen 38. Similarly oxygen-rich vapor from each of cold boxes B and C is passed in streams 43 and 44 respectively into stream 39, and passed as one stream through primary heat exchanger 6 prior to recovery as product oxygen 40. As can be appreciated each of the product streams from each of the cold boxes may be passed separately through the primary heat exchanger and may be separately recovered.

In the practice of this invention the design capacity of the modular cold boxes may be within the range of from 50 to 1500 tons per day of product oxygen, and the design feed air input flowrate into each of the modular cold boxes maybe within the range of from 0.24 to 7.2 million cfh. The system of this invention may have an aggregate capacity of up to 6000 tons per day of product oxygen. Preferred standard design capacities for modular cold boxes in the practice of this invention are 250 and 400 tons per day of product oxygen. The 250 tons per day of product oxygen cold box module is well suited to process the prepared feed air available from the full size brazed aluminum heat exchanger core serving as the primary heat exchanger 6 and matches well with the available heat exchangers to provide cost effective plant equipment. Likewise, the 400 tons per day of product oxygen cold box module matches well with the prepared feed air from two full size brazed aluminum heat exchanger cores and is the maximum shop fabricated shippable unit that thereby avoids the added costs associated with field fabrication. Those skilled in the art are familiar with the techniques for designing a cold box module so that it has a capacity to handle a specified feed air flowrate and produce oxygen at a specified number of tons per day.

Now with the practice of this invention wherein a plurality of similarly sized cold box modules are operated in parallel in conjunction with a feed air preparation system, cryogenic rectification plants having a wide variance in capacity may be efficiently fabricated without a costly separate extensive design by adding or subtracting standard size cold box modules, thus significantly reducing the time and the cost of building cryogenic rectification plants. Although the invention has been described in detail with reference to a certain embodiment, those skilled in the art will recognize that there are other embodiments of the invention within the spirit and the scope of the claims. For example, one or more cold boxes having a capacity different form that of the defined plurality of same capacity cold boxes may additionally be used to receive additional prepared feed air from the feed air preparation system and produce additional product such as product oxygen.

We claim:

1. A method for carrying out cryogenic rectification of feed air to produce oxygen comprising:

(A) processing feed air in a feed air preparation system to produce prepared feed air;

(B) passing the prepared feed air in a plurality of inputs into a plurality of cold boxes, each of said inputs having the same flowrate and passed into a single cold box;

(C) producing oxygen by cryogenic rectification in each of the cold boxes, and (D) passing oxygen from each of the cold boxes to the feed air preparation system and recovering product oxygen from the feed air preparation system.

2. The method of claim 1 further comprising producing and recovering product nitrogen from at least one of the cold boxes.

3. The method of claim 1 further comprising producing and recovering product argon from at least one of the cold boxes.

4. Apparatus for carrying out cryogenic rectification of feed air to produce oxygen comprising:

(A) a feed air preparation system and means for passing feed air into the feed air preparation system;

(B) a plurality of cold boxes, each cold box having the same capacity, and means for passing feed air from the feed air preparation system into each of the cold boxes;

(C) means for passing oxygen from each of the cold boxes to the feed air preparation system; and (D) means for recovering product oxygen from the feed air preparation system.

5. The apparatus of claim 4 wherein each of the cold boxes comprises a double column.

6. The apparatus of claim 4 wherein at least one of the cold boxes comprises an argon column.

* * * * *